US005348137A

United States Patent [19]

Palmer

[11] Patent Number: 5,348,137

[45] Date of Patent: Sep. 20, 1994

[54] VERTICAL TENSIONING AND ANTI-ROTATIONAL DEVICE FOR USE WITH SINGLE CONTINUOUS ROPE CONVEYOR LIFTING SYSTEM

[76] Inventor: R. Gary Palmer, 5202 Dow Rd., Houston, Tex. 77040

[21] Appl. No.: 149,079

[22] Filed: Nov. 9, 1993

[51] Int. Cl.[5] ..... B65G 15/00

[52] U.S. Cl. ..... 198/643

[58] Field of Search ..... 198/643; 415/5; 417/320; 418/4

[56] References Cited

U.S. PATENT DOCUMENTS

| | | | |
|---|---|---|---|
| 1,799,086 | 3/1931 | Laretta | 198/643 |
| 2,391,642 | 12/1945 | Reed | 198/643 X |
| 2,438,298 | 3/1948 | Reed | 198/643 X |
| 2,693,759 | 11/1954 | Abellanet | 198/643 |
| 2,704,981 | 3/1955 | Gustafson | 198/643 X |
| 3,774,685 | 11/1973 | Rhodes | 198/643 X |
| 4,636,145 | 1/1987 | Donaldson | 417/320 X |
| 5,048,670 | 9/1991 | Crafton et al. | 198/643 |
| 5,080,781 | 1/1992 | Evins, IV | 198/643 X |

*Primary Examiner*—James R. Bidwell

*Attorney, Agent, or Firm*—Conley, Rose & Tayon

[57] ABSTRACT

A vertical tensioning and anti-rotational device for use with a single continuous rope conveyor lifting system, the lifting system having a series of powered pulleys disposed at the top of a well for continuously driving a rope in a closed loop into the well, into and out of downhole fluids, and back to the top of the well, carrying a portion of such fluids out of the well. The device includes a tubular body open at one end, and a tension bar telescoped into the open end. The tubular body and tension bar member are adapted to fit diametrically into a well bore. A spring biases the tension bar member away from the tubular body. Extension bar members are disposed on the opposite ends of the tubular body and tension bar member, and extend longitudinally axially along the walls of the well bore. Sharp-edged rollers are disposed on the upper and lower ends of the extension bar members. The spring biases the rollers against the walls of the well bore, and the rollers prevent the device from rotating. The conveyor rope loops around a sheave mounted near the center of the upper surface of the tubular body. A dead weight is attached near the center of the lower surface of the tubular body.

9 Claims, 4 Drawing Sheets

VERTICAL TENSIONING AND ANTI-ROTATIONAL DEVICE FOR USE WITH SINGLE CONTINUOUS ROPE CONVEYOR LIFTING SYSTEM

BACKGROUND OF THE INVENTION

1. Field of Invention

The present invention relates generally to the field of lifting fluids from well bores with a conveyor comprising a single continuous line or string of moving rope. More particularly, the present invention relates to apparatus and methods for compensating for and overcoming the inherent tendency of such a single rope conveyor to stretch and twist during operation.

2. Background Art

Systems used to remove liquids from new and existing well bores have changed very little over the years. Many variations have been proposed or tried, but most have failed or had limited success or applications due to physical limitations and/or a prohibitive cost.

The electrical submersible pump system has worked well for large volume producing wells and for very shallow "backyard variety" water wells, but is not economically feasible for the production of medium depth wells and/or marginal production wells.

The fill the gap, the downhole piston pump has been used almost exclusively around the world to produce the medium depth, marginal production wells. These pumps are powered by long strings of steel rods pushed in and out of the well bore by means of a powered eccentric system. Normally called walking beam pumps, these pumps have performed acceptably for many years and are still the industry standard. But walking beam pumping systems are expensive to purchase initially, and have very high maintenance costs. Another drawback of these pumps, in addition to high start-up and operating costs, is that cavitation occurs down hole on a regular basis. Cavitation in a down hole pump creates a turbulent movement of liquids in the well bore which limits the life of the pump and could disturb the formation, thus limiting the production from the well. Moreover, in an oil well with paraffins present, the valves in a walking beam pump can become plugged by the paraffins and cause pump failure, thus further limiting the usefulness of the walking beam pump in the oil patch.

Other conveyor-type systems have been tried and have failed due to design errors and limited applications. One of the most recent attempts at using a conveyor-type system is the Crafton Lift System as shown, for example, in U.S. Pat. No. 5,048,670. In that device, a single continuous rope conveyor travels through a tubular annulus. The utility of that system is limited, however, due to the elasticity characteristics of the tube and rope used as the carriers for lifting the liquids. In the absence of sufficient continuous tensioning force on the rope to "set" it, excess vibration could occur, even to the point of permitting natural harmonic vibrations to occur in the rope. As a result of this vibration, the fluids are quite literally shaken from the conveyor rope. Thus, in order to assure smooth operation and minimize fluid loss, it would be advantageous to reduce or eliminate any slack in the conveyor rope. Moreover, placing the required tubes in deep wells can be a very time-consuming and expensive proposition, in terms of both material costs (the tubes themselves) and the costs for installation, removal, and storage of the tubes. Furthermore, in the event that a tube breaks or becomes stuck down hole, the operator could be faced with a difficult and expensive fishing operation.

SUMMARY OF THE INVENTION

The present invention compensates for and overcomes the drawbacks of a single continuous rope conveyor system referred to above in terms of both elasticity and rotational entanglement, fulfilling the need for an alternative, low-cost system to lift liquids from wells of virtually all types. The benefits of the present invention can probably be shown most dramatically in connection with low-producing oil wells in the United States and elsewhere that today are slated for plugging. The vertical tensioning and anti-rotational features of the present invention allow the efficient, effective application of Newton's Law of Fluid Viscosity in a single continuous rope conveyor lifting system to produce virtually any size or depth of well bore, including those low-production wells which are currently on the "shut-in list."

Rather than using a pumping mechanism or relying on annular flow phenomena, the novel and unique methods and apparatus detailed herein rely on adherence by the fluid to the flexible lifting apparatus for energizing the fluid to the top-side gathering basin. This adherence follows from a principle of fluid mechanics known as Newton's Law of Fluid Viscosity, which tells us that the inherent resistance to shear in fluids will cause them to adhere to a moving object up to a thickness where the shear forces become greater than the forces causing the adherence. This basic principle is at the heart of the novel and unique fluid lifting methods and apparatus which are described herein.

The fluid lifting system of the present invention comprises a series of pulleys driven by a power source, which rotates a single continuous rope into and out of a well bore containing a liquid, such as crude oil. The rope is continuously driven around the pulleys from the top of the well, down into the fluid, and up to the top of the well again. As the rope is driven from the down hole fluid to the top of the well, it carries with it a layer of the fluid, the thickness of which depends in part on the Law of Fluid Viscosity referred to above; it also depends on other factors such as the absorbency of the rope, the size of the rope, and the surface area of the rope exposed to the fluid. When the moving rope reaches the top of the well, it passes over the pulleys and crosses back upon itself in a "figure 8" pattern, dislodging a substantial portion of the fluid into a collection basin or housing at the surface.

The present invention comprises a vertical tensioner and anti-rotational device located inside the well bore at the bottom of the lifting system, below the level of fluids in the well. A tubular body open at one end carries a compression spring therewithin, one end of which engages the end of a tension bar member telescopingly received in the open end of the tubular body. The other end of the tubular body is affixed to a first extension bar, and the other end of the compression spring engages this first extension bar. A second extension bar is affixed to the other end of the tension bar member. The tubular body and tension bar member are sized to fit diametrically or transversely in the well bore, with the extension bars engaging, and extending longitudinally axially of, the walls of the well bore. The compression spring biases the tension bar member longitudinally axially away from the tubular body, thus forcing the first and second extension bars into engagement with the well bore walls when the apparatus of the invention is positioned properly in the well.

At the upper and lower ends of each of the extension bars, a relatively sharp-edged roller is rotatably carried on a pin disposed on the extension bars transversely of the well bore axis for rollably engaging the walls of the well bore as the extension bars are forced outwardly into engagement with those walls. The rollers are carried such that they roll in a plane substantially parallel to the longitudinal axis of the well bore. The relatively sharp edges of tile rollers engaging the well bore walls, with the assistance of the spring bias, substantially prevent rotation of the apparatus of the present invention in the well bore.

An upper yoke is attached to the top surface of the tubular body near its center, and a grooved wheel or sheave is rotatably mounted in the yoke. The grooved wheel or sheave rotates on an axis in a plane substantially transverse to that in which the rollers disposed on the ends of the extension bars roll, but also substantially parallel to the longitudinal axis of the well bore. The continuous rope of the conveyor system of the present invention passes around this sheave, at the lower end of the system.

By preventing rotation of the apparatus with the rollers biased against the well bore walls as discussed above, the rope passing around this lowermost sheave is prevented from becoming twisted or entangled.

A dead weight is attached to a yoke affixed to the underside of the tubular body near its center, to apply a substantial controlled stretch or tension to the rope at the bottom of the conveyor system to promote smooth, even, continuous movement of the rope. The dead weight eliminates slack in the conveyor rope and prevents the excess vibration, for example that due to harmonics, from prematurely dislodging the fluids. The dead weight also assists in lowering the device to the bottom of the well quickly and smoothly.

With the vertical tensioning and anti-rotational device of the present invention in place in a well bore, a single rope-type conveyor system of the most simplistic construction now becomes a viable alternative for lifting fluids from virtually any configuration or depth of well bore. The system is relatively inexpensive, and can be powered relatively cheaply by wind, gas engine, or electromechanical, pneumatic, or solar power. In addition, using the present invention in a single rope-type conveyor system will eliminate the cavitation problems presently experienced with other types of systems.

The described features and advantages of the present invention will be apparent to those skilled in the art of mechanical devices as they read the detailed description and observe the drawings of the invention illustrated in FIGS. I through IV.

DETAILED DESCRIPTION OF THE PREFERRED EMBODIMENT OF THE INVENTION

Figure 1:
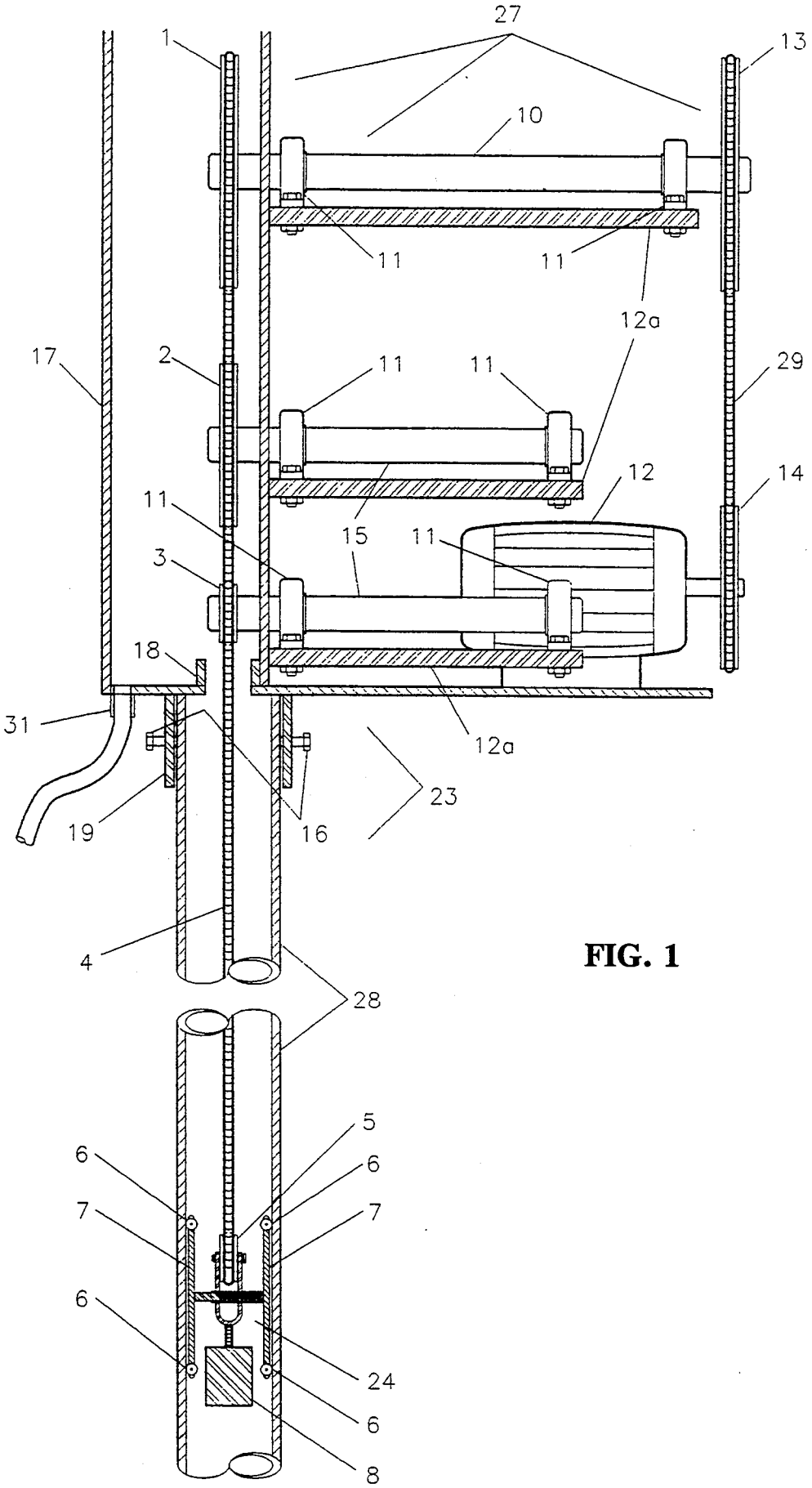
FIG. 1 is a fragmentary, side elevational view, partly in section, of a single continuous rope conveyor system for lifting liquids from a well bore with the tensioning and anti-rotational device of the present invention in place in the well bore.

In the description which follows, terms such as "upper," "lower," and "vertical" are used in their relative senses with reference to the apparatus of the present invention as installed in a well bore, and as shown in the drawings. Thus, "upper" refers to an up hole direction, and "lower" refers to a down hole direction. "Vertical" means in an up and down direction or plane.

Referring to the drawings, and first to FIG. 1, a simplified representation of a single continuous rope-type conveying apparatus for lifting fluids is illustrated generally at 23. The conveying system 23 utilizes a tensioning and anti-rotational device of the present invention, shown generally at 24, at the bottom thereof. The single continuous rope-type conveying apparatus 23 comprises an assembly 27 of a powered series of sheaves 1, 2, 3, 13, and 14 used to create a continuous movement of a conveyor rope 4 along a continuous path in and out of a string of pipe 28. Assembly 27 is powered by a power source 12 such as, for example, an electric motor, which transmits power to sheave 1 through sheaves 14 and 13. Of course, any suitable power source 12 could be used instead of an electric motor, such as water power, wind, solar power, or the like. Three shafts 10, 15 (reference numeral 15 indicating two shafts), on which sheaves 1, 2, 3, 13, and 14 are mounted, are each supported by a pair of bearings 11 near their opposite ends. Bearings 11 are secured in place by support members 12*a*. Support members 12*a* are welded to a housing 17 for rigidity.

Figure 2:
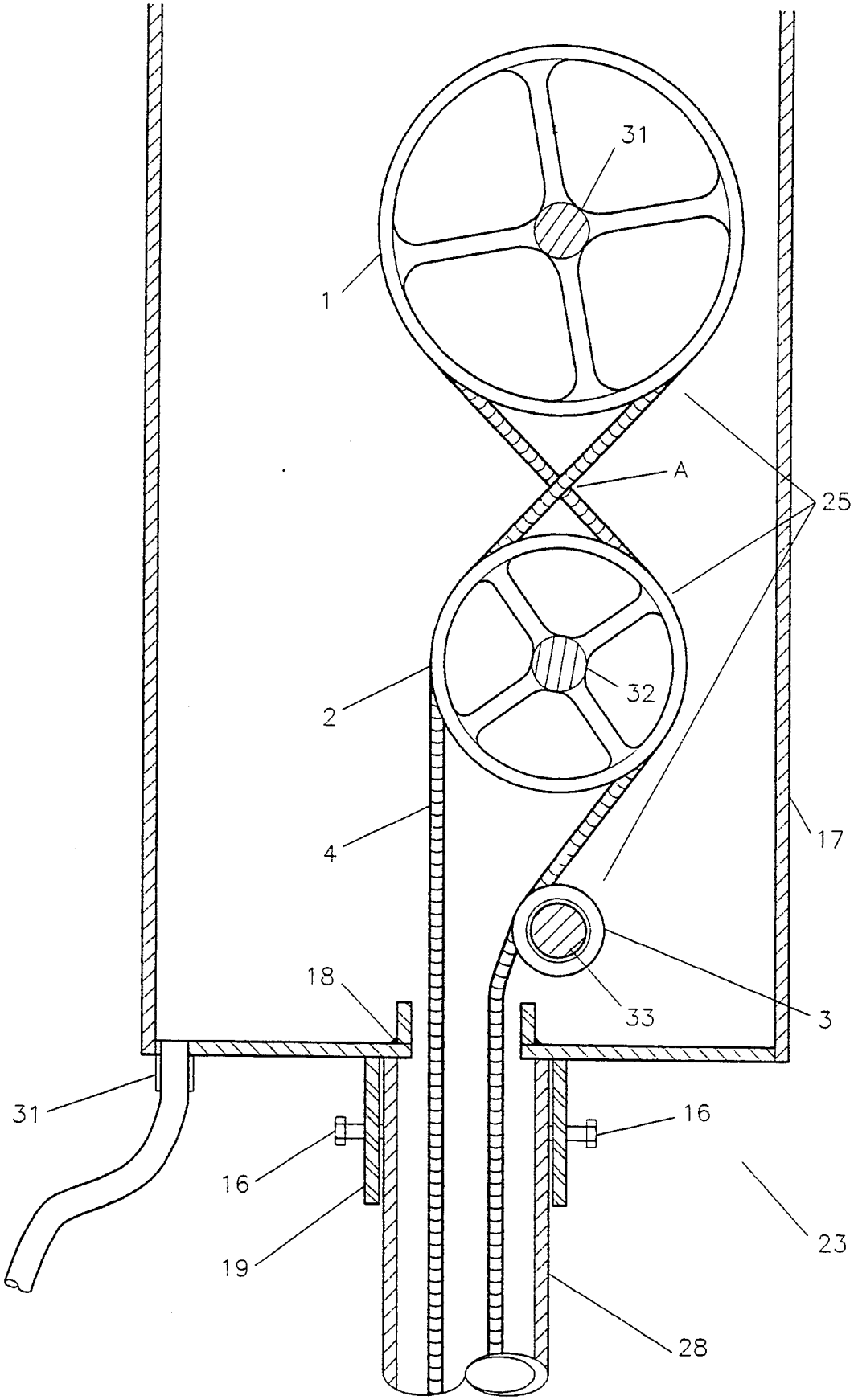
FIG. 2 is a front elevational view, partly in section, of the "figure 8" pulley system used in conjunction with the present invention for energizing the single continuous rope conveyor system.

Sheave 1 is powered by power source 12 through sheaves 14, 13, belt 29 between sheaves 14, 13, and shaft 10 on which sheaves 1 and 13 are mounted. Sheave 1 is considered the drive sheave, and is larger in diameter than sheaves 2 and 3 in order to provide more surface contact for rope 4 to minimize or prevent slippage of the rope during operation. Sheaves 2 and 3 are sized differently, as shown in FIG. 2, to allow for alignment of rope 4 into tubing 28. Rope 4 is placed onto sheaves 1 and 2 in a "figure 8" configuration, as best shown in FIG. 2, to allow the rope to make maximum contact with sheaves 1, 2 and to cross upon itself at point A to disengage the maximum amount of fluid from rope 4 prior to reentering tubing 28. Sheaves 1, 2, 3 are preferably aligned such that their center points 31, 32, 33 lie in a continuous straight line. Sheaves 2 and 3 are then sized accordingly to allow for the proper alignment of rope 4 into and out of tubing 28. Sheave 1 is rotated in a clockwise direction to allow rope 4 to pass over sheave 3 as it enters into the storage compartment 17 to maximize the disengagement of liquid from rope 4 during its passage around sheaves 3, 2, and 1.

Assembly 17 preferably is a rigid framed housing for storing conveyed liquids, supporting assembly 27 and the tensioning and anti-rotational device 24 of the present invention, and securing the rope-type conveying system 23 to the top of tubing string 28. A downwardly extending tubular member 19 is disposed on the bottom of the housing 17 for use in mounting the housing to the tubing string 28. This is effected by sliding tubular member 19 over the top of tubing string 28 and locking it into place by tightening locking bolts 16 against the tubing. Tubular member 19 and locking bolts 16 allow for the rotation of housing 17 on the tubing string 28 after rope 4 is placed into the tubing and assembly 24 of the present invention is in place, thus allowing for proper alignment of rope 4.

Liquid from the well enters into storage housing 17 via entrance 18. Entrance 18 has a raised edge entirely surrounding the rope 4 where it enters the housing 17 to minimize the return of liquids into tubing 28 after they have been removed from rope 4. An outlet 31 in the bottom of housing 17 allows liquids entering the housing through entrance 18 to be removed from the housing and transferred to another location.

Figure 3:
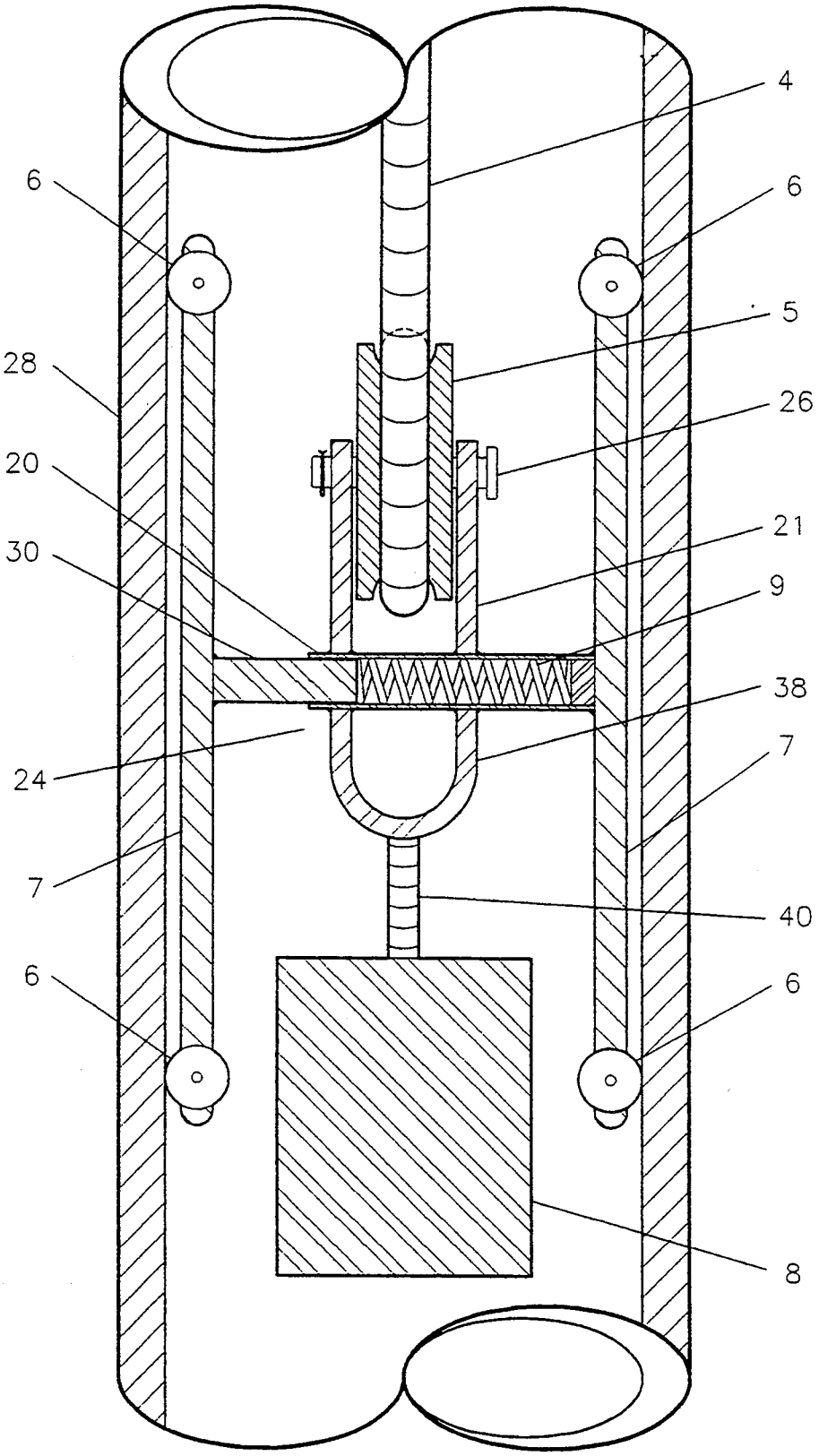
FIG. 3 is an enlarged, front elevational view, partly in section, of the single continuous rope conveyor system tensioning and anti-rotational device of the present invention located inside a well bore.
Figure 4:
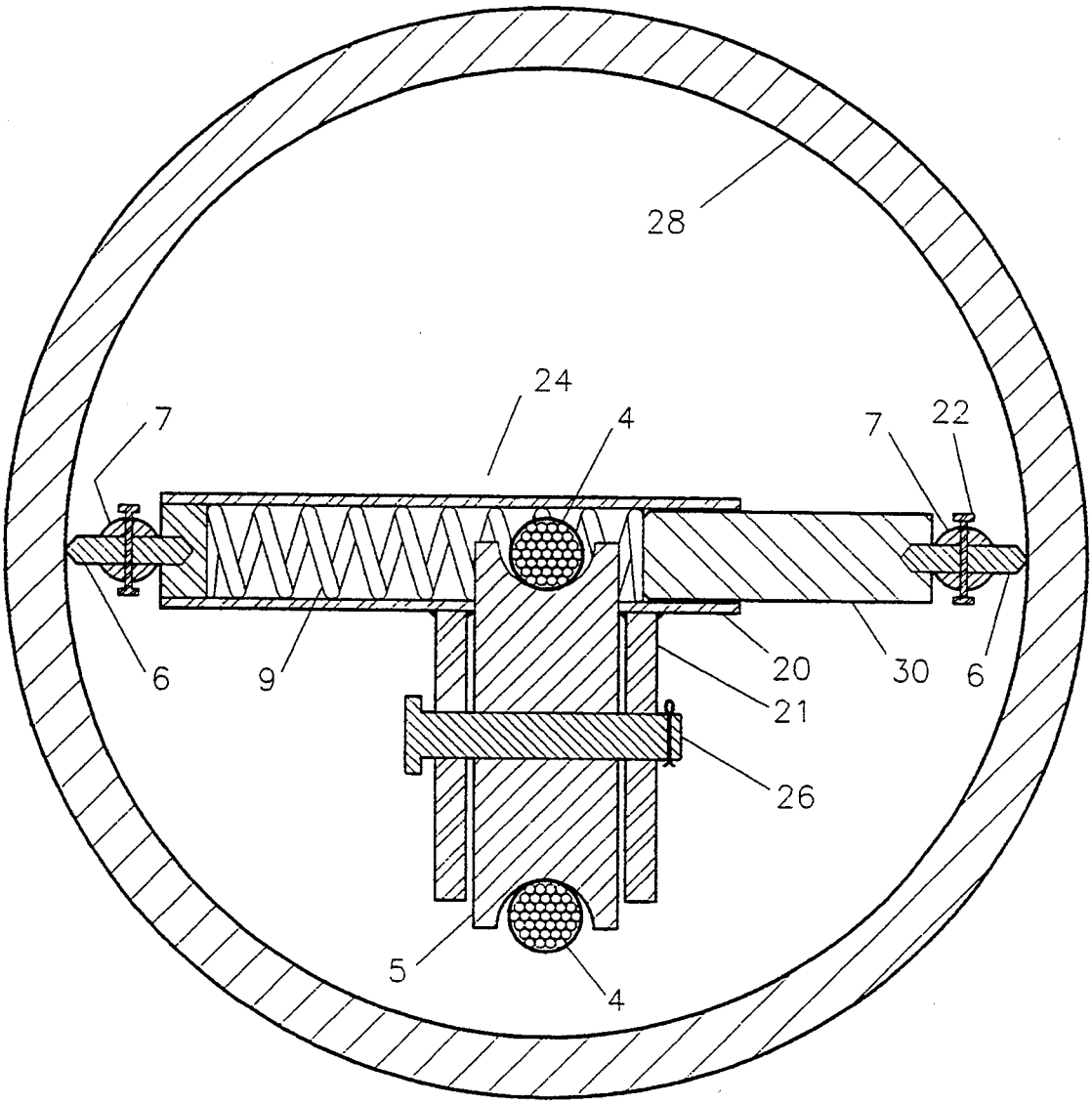
FIG. 4 is an enlarged, top plan view, partly in section, of the single continuous rope conveyor system tensioning and anti-rotational device of the present invention located inside a well bore.

Apparatus 24 of the present invention, which may be viewed as a down hole antirotational and vertical tensioning device, is the key component in making conveying system 23 a viable liquid lifting system. With particular reference to FIGS. 3 and 4, apparatus 24 includes a spring 9 compressed inside a tube 20 such that when the apparatus 24 is confined within a section of tubing string 28, the spring 9 applies a constant pressure against the end of a metal bar 30 which telescopes in and out of tube 20 a distance depending on the diameter of tubing string 28. Metal bar 30 may have any of a variety of cross sections, such as round, square, rectangular, or the like. Spring 9 confined in tube 20 applies a constant force on bar 30.

Bar 30 and tube 20 are securely affixed, as by welding, to extension bars 7. Extension bars 7 have rollers 6 mounted on their upper and lower ends for engaging against and conforming to the inside diameter of tubing string 28, through the pressure applied against the rollers by spring 9 compressed inside tube 20. Tube 20, bar 30, and spring 9 can, of course, be made in different lengths to conform to different tubing string 28 diameters. Extension bars 7 have a design length to fix them, and thus the apparatus of the present invention, in a vertical traveling position according to different diameters of tubing string 28. The larger the diameter of tubing string 28, the greater should be the axial lengths of the extension bars 7. Extension bars 7 are preferably of substantially the same axial length, and preferably extend substantially the same distance above and below the tube 20 and bar 30 received therewithin. Rollers 6 are fixed in place on the upper and lower ends of extension bars 7 by means of pins 22, thus allowing them to rotate freely in a vertical plane. Rollers 6 are designed with a sharp edge for engaging the inside wall of the tubing 28 to allow free movement of the device 24 up and down the vertical plane of the tubing, yet preventing any rotational movement of apparatus 24 inside the tubing. The ends of the extension bars are slotted, with a single slot extending longitudinally axially of each of the upper and lower ends of the respective extension bars so that the rollers 6 may be received in the slots. The pins 22 are transversely disposed through the extension bars at the location of the slots so that the rollers may receive the pins when they are properly disposed in the slots.

An upper yoke 21 is affixed, as by welding, to the upper surface of tube 20 such that it is substantially parallel to extension bars 7. A sheave 5 is mounted in yoke 21 by a transversely extending pin 26 which allows sheave 5 to rotate freely. Continuous length of rope 4 attaches apparatus 24 of the present invention to apparatus 23, thus allowing apparatus 24 to be suspended vertically inside tubing string 28. Rope 4 travels freely into and out of tubing string 28 as sheave 5 rotates on pin 26.

A lower yoke 38 is affixed, as by welding, to the lower surface of tube 20 for attachment of a dead weight member 8 through a cable 40. Dead weight 8 applies a constant downward tensioning force on rope 4, and also assists in lowering the device quickly and efficiently down the well bore. The constant tensioning force removes slack from the rope and helps eliminate unwanted vibrations, as from harmonics, from the rope as it travels in the well bore. Removing slack and reducing vibration are very important to operating an efficient rope-type conveyor system because unwanted vibrations, such as those resulting from harmonics, can prematurely dislodge the fluids from the rope. By reducing vibrations and running a smooth rope, efficiency and production volume of the system both increase. The dead weight helps to "set" the rope, that is, to eliminate slack, by applying a constant tensioning force to the rope. By controlling the amount of weight placed on the rope, along with the speed at which it ooperates, its operating characteristics can be adjusted to meet service requirements and result in the smoothest operation possible. The weight of dead weight member 8 may also be varied to accommodate different sizes and lengths of rope 4, and different diameters of tubing string 28.

It has been found that all rope-type conveyors used in the past which are suitable for lifting fluids through well bores have an inherent elasticity and a tendency to entangle or spiral if suspended in a well bore of several hundred feet in depth. To use the single continuous moving rope-type conveyor system and apply Newton's Law of Fluid Viscosity to efficiently and effectively lift fluids from new and existing well bores, the rope must move continuously and smoothly, without spiraling and without becoming entangled. By using the vertical-tensioning, anti-rotational device of the present invention to anchor the rope conveyor system inside a well bore, preventing rotational movement in the well bore and providing a continuous downward tensioning of the rope, the rope will travel continuously and smoothly without undue vibration and without spiraling or becoming entangled, thus providing an efficient, effective fluids lifting system. As a result, a single continuous moving rope conveyor system equipped with the anchoring, tensioning, and anti-rotational device of the present invention can be used for lifting fluids from virtually any size or depth of well bore.

While preferred and alternative embodiments of the invention have been shown and described, many modifications thereof may be made by those skilled in the art without departing from the spirit of the invention. Accordingly, the scope of the present invention should be determined in accordance with the following claims.

I claim:

1. A vertical tensioning and anti-rotational device for use with a single continuous rope conveyor lifting system, the lifting system having a series of powered pulleys disposed at the top of a well for continuously driving a rope in a closed loop into the well, into and out of downhole fluids, and back to the top of the well, carrying a portion of such fluids out of the well, comprising:

a tubular body open at a first end, said tubular body having a longitudinal axis;

means rotatably affixed to said tubular body for receiving said rope and for permitting said rope to loop around said tubular body on its way into and then out of the well bore;

a tension bar member having a first end telescopingly received in said open first end of said tubular body;

said tubular body and said tension bar member being adapted for placement diametrically into the well bore;

means for biasing said tension bar member away from said tubular body in a longitudinally axial direction;

a first extension bar member having upper and lower ends and disposed on a second end of said tubular body opposite said first end, and extending longitudinally axially of said well bore when said tubular body is diametrically disposed in said well bore, said first extension bar member extending above and below said tubular body;

a second extension bar member having upper and lower ends and disposed on a second end of said tension bar member opposite said first end thereof, and extending longitudinally axially of said well bore when said tension bar member is diametrically disposed in said well bore, said second extension bar member extending above and below said tension bar member; and anti-rotational means disposed on said upper and lower ends of said extension bar members for engaging the walls of the well bore and substantially preventing rotation of said device with respect to said well bore, said means for biasing said tension bar member away from said tubular body biasing said anti-rotational means against the well bore walls.

2. A vertical tensioning and anti-rotational device according to claim 1, wherein said biasing means comprises a compression spring disposed in said tubular body between said first end of said tension bar and said first extension bar member attached to said second end of said tubular body.

3. A vertical tensioning and anti-rotational device according to claim 1, wherein said means rotatably affixed to said tubular body for receiving said rope includes a yoke affixed to the upper surface of said tubular body near its center, and a sheave rotatably mounted in said yoke, said rope passing in a loop around said sheave.

4. A vertical tensioning and anti-rotational device according to claim 3, wherein said sheave rotates in a plane substantially parallel to the longitudinal axis of the well bore.

5. A vertical tensioning and anti-rotational device according to claim 1, wherein said anti-rotational means disposed on said upper and lower ends of said extension bar members for engaging the walls of the well bore includes rollers disposed on the extension bar members, for rotation in planes substantially parallel to the longitudinal axis of the well bore.

6. A vertical tensioning and anti-rotational device according to claim 5, wherein said rollers have relatively sharp edges for engaging the walls of the well bore.

7. A vertical tensioning and anti-rotational device according to claim 1, and further including a dead weight affixed to the lower surface of the tubular body near its center for applying controlled tension to the conveyor rope.

8. A vertical tensioning and anti-rotational device according to claim 1, wherein said extension bars are of substantially the same length, and extend substantially the same distance above and below said tubular body and said tension bar member.

9. A device according to claim 1, wherein said pulleys of said system include a drive pulley, a second pulley of smaller diameter than said drive pulley and axially aligned with said drive pulley therebelow for receiving the rope in a figure 8 pattern around said drive pulley and said second pulley, and a well bore alignment pulley disposed beneath said second pulley and axially aligned with said drive pulley and said second pulley and sized for permitting the rope to pass around said alignment pulley when exiting the well bore, prior to entering said figure 8 pattern.

* * * * *